United States Patent [19]

Loix

[11] Patent Number: 4,457,398

[45] Date of Patent: Jul. 3, 1984

[54] ELEMENTS TO BE ASSEMBLED TO FORM TEMPORARY STAIR

[76] Inventor: Gilbert Loix, rue Bourgogne 5, Juprelle, Belgium

[21] Appl. No.: 341,020

[22] Filed: Jan. 20, 1982

[30] Foreign Application Priority Data

Jan. 22, 1981 [BE] Belgium ..... 887181

[51] Int. Cl.[3] ..... E04G 27/00; E06C 1/00; E06C 7/08

[52] U.S. Cl. ..... 182/151; 182/93; 182/194; 182/228; 52/182

[58] Field of Search ..... 52/182; 182/194, 93, 182/151, 1, 122, 121, 120, 106, 228

[56] References Cited

U.S. PATENT DOCUMENTS 3,713,511 1/1973 Hinkle ..... 52/182

FOREIGN PATENT DOCUMENTS 57168 8/1982 European Pat. Off. ..... 52/182

*Primary Examiner*—John E. Murtagh
*Assistant Examiner*—Michael Safavi
*Attorney, Agent, or Firm*—Darby & Darby

[57] ABSTRACT

Elements to be assembled to form in situ a temporary stair, from a pair of planks (1,1') or longitudinally sawn boards, or identical cross-section, intended for serving as stringers and which elements consist of steps (2), identical with one another, the steps being self-locking one by means of another onto and against the planks (1,1'), with the exception of the top step which has to be wedged against these planks (1,1'); each step (2) rests, at each side at the front, on the upper edge of a plank and, at the rear, is brought against the lower edge of the plank by a pair of flats (14,14') terminating in a hook (16) and mounted freely pivotal in the step placed next above.

7 Claims, 10 Drawing Figures

Figure 1:
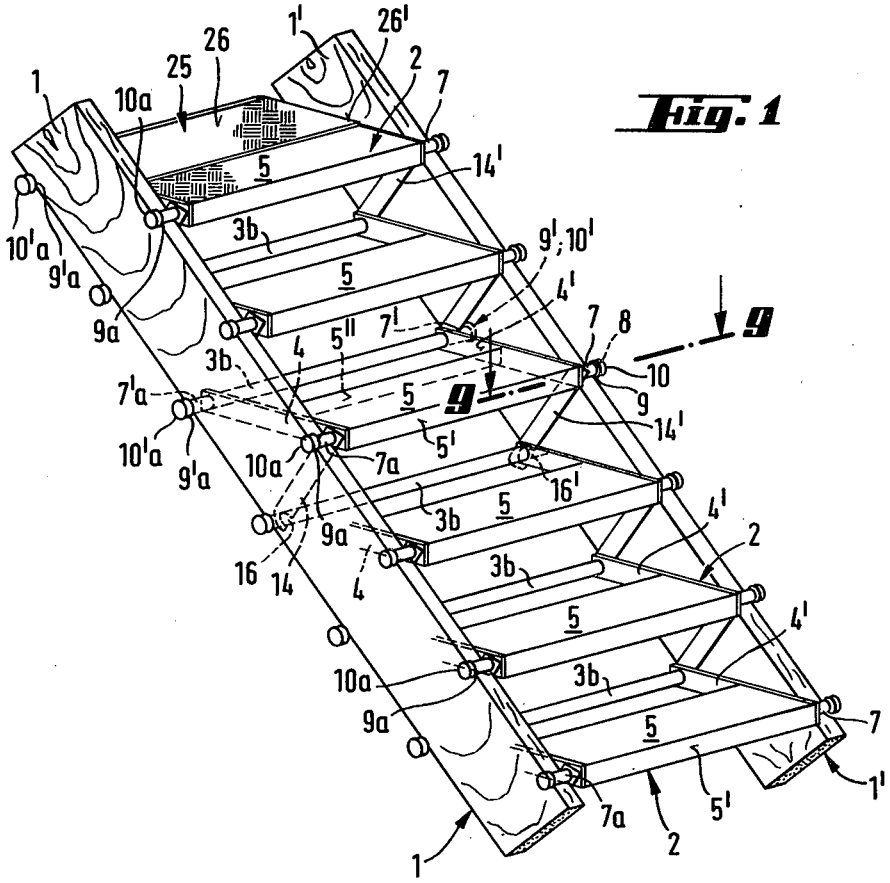

6
6
1
2
3a
3,7,7a
3,7,7a
4
5
5'
5''
6a
6'a
7'a,3b,7'
9a
9'a
10a
10'a
11'a
17
18
19
20
21

1
2
3b
4
5
5'
6a
6'a
7a
7'a
9a
9'a
10a
10'a
17
17a
18
19
20
21

ELEMENTS TO BE ASSEMBLED TO FORM TEMPORARY STAIR

This invention relates to elements to be assembled to form in situ a temporary stair, for example a stair such as is used on building sites for reaching the first floor when the walls of the ground floor have been completed.

It is known that on building sites this type of temporary stair is at present constructed on the job from two large planks or longitudinally sawn boards, between which are nailed shuttering planks sawn to the desired dimensions, in order to form the steps and that this stair is if necessary edged with a hand rail, a lateral guard rail, on one or both sides, by means of stringers and boards.

A stair constructed in this manner may, of course, be solid and stable; it nevertheless possesses a certain number of disadvantages and dangers; in time of rain the surface of the steps becomes slippery, since being frequently made of re-used wood these steps do not always have the desired strength and are sometimes partly split.

On the other hand, after use and at latest when the site has been completed, these temporary stairs are totally demolished and the planks alone are sometimes recovered.

The present invention overcomes these disadvantages, by proposing elements to be assembled together, which provide all the necessary assurances of robustness and solidity, steps equipped with a non-slip surface, the elements being especially simple and rapid to assemble.

These elements to be assembled to form in situ a temporary stair from a pair of planks or longitudinally sawn boards, of identical cross-section, intended for serving as stringers, are characterized in that they consist of steps identical with one another, the steps being self-locking one by means of another onto and against the planks, with the exception of the first step which has to be wedged against the planks, each step being composed of at least two tubes onto two of which there engages a plate, preferably grooved or scored, forming the non-slip surface of the step proper, the tubes being held, at each of their reduced diameter ends, by a flat equipped with openings into which these reduced diameter ends of these tubes are slid, the flats thus forming cheek plates, of which tubes two separated by at least a distance substantially exceeding the width of the planks are extended by a bushing having a length substantially exceeding the thickness of a plank, the bushings being held and fixed to the tubes which they extend at either end and onto which bushings there are either slid firstly a bearing member having a length slightly greater than the thickness of the planks and thereafter a first, simple washer, followed preferably by a special washer, or onto which bushings there is fixed a second, complementary external flat forming a cheek plate; and in addition on each of the two front bushings of each step there is also mounted freely pivoting, at one end, a flat terminating at the other end in a hook-shaped portion intended for engaging on the bushing of the step placed next below, in such a manner that each step rests, at each side at the front, by a bushing and/or the bearing member slid onto it, on the upper edge of one plank, and at the rear at the other bushing and/or the bearing member slid onto it is pulled against the lower edge of said plank by the flat terminating in a hook of the step placed next above, with the exception of the first step starting from the top, the rear bushing of which and/or bearing member slid onto it should be held against the lower edge of said plank, which furthermore is clamped between the cheek plate and the two simple washers or the complementary external cheek plate.

Preferably, the temporary stair according to this invention is equipped with other elements to be joined together, guard rail uprights on which the guard rail proper may be formed by means of simple boards, or again there may be fixed to these uprights elements to be joined together forming a hand rail for the stair.

Figure 2:
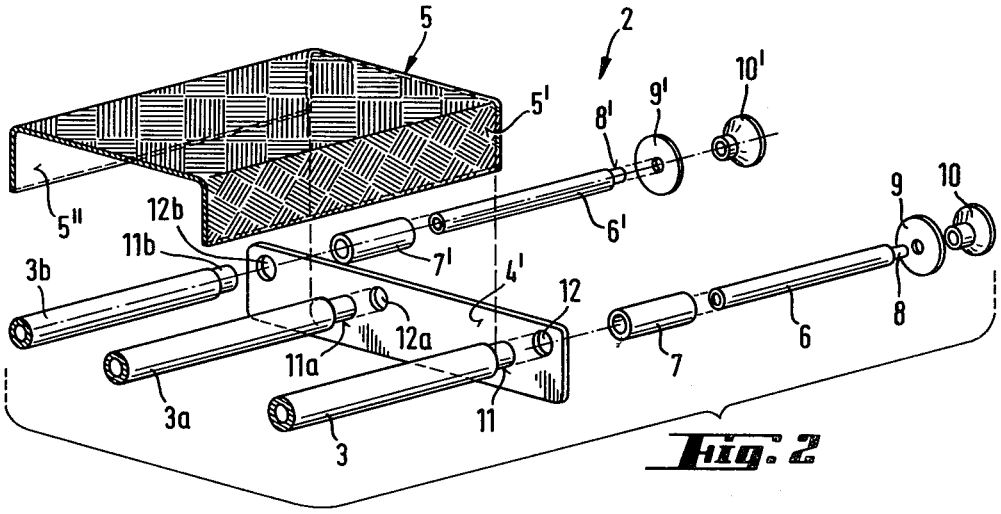
Figure 3:
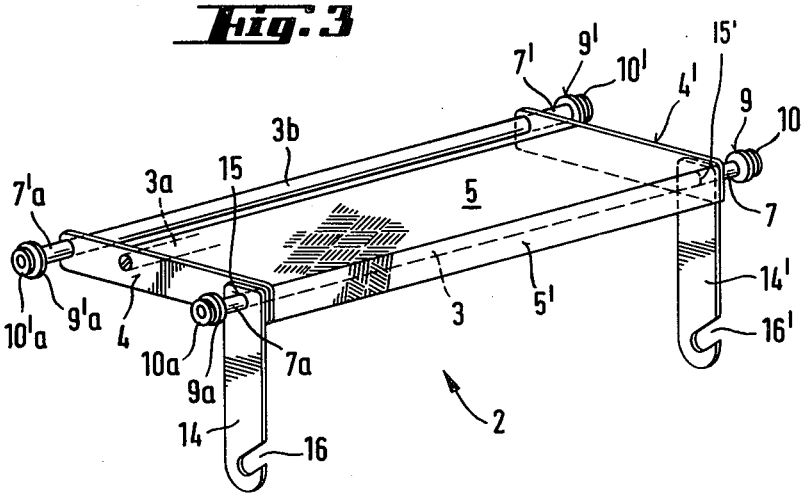
Figure 4:
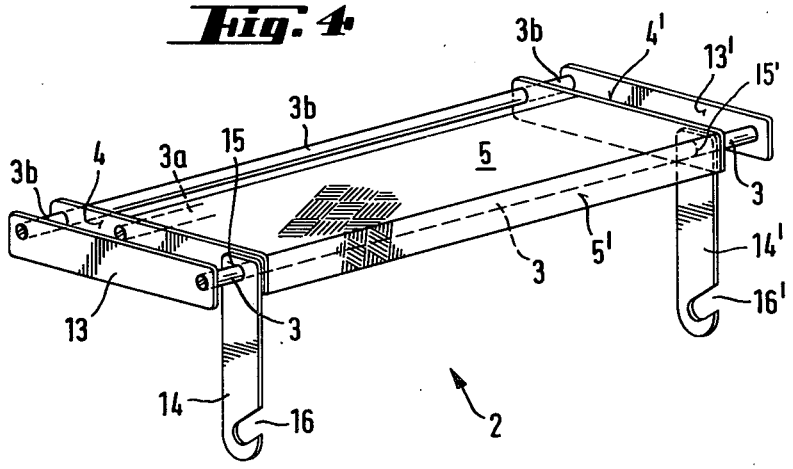
Figure 8:
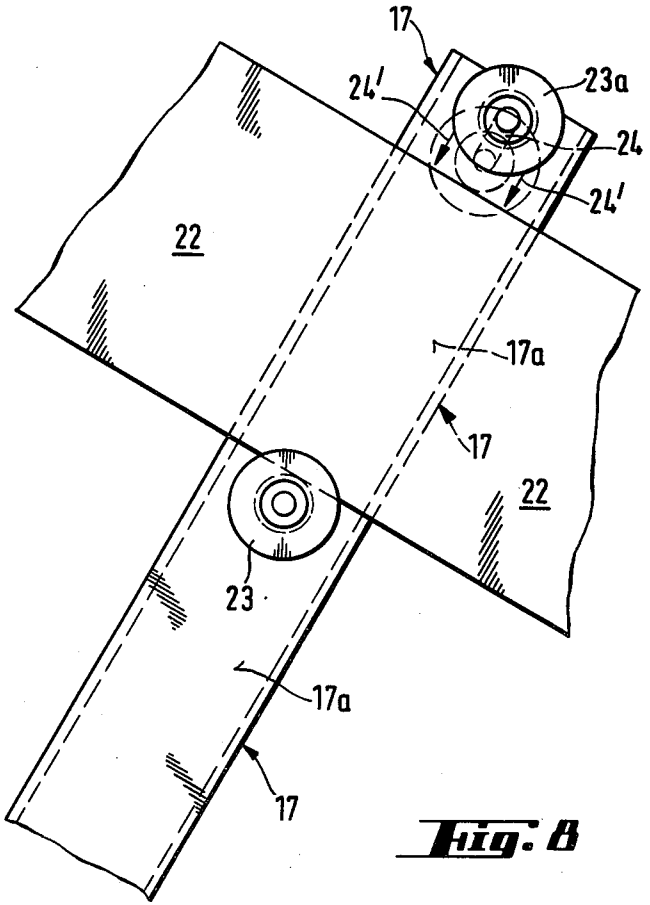
Figure 5:
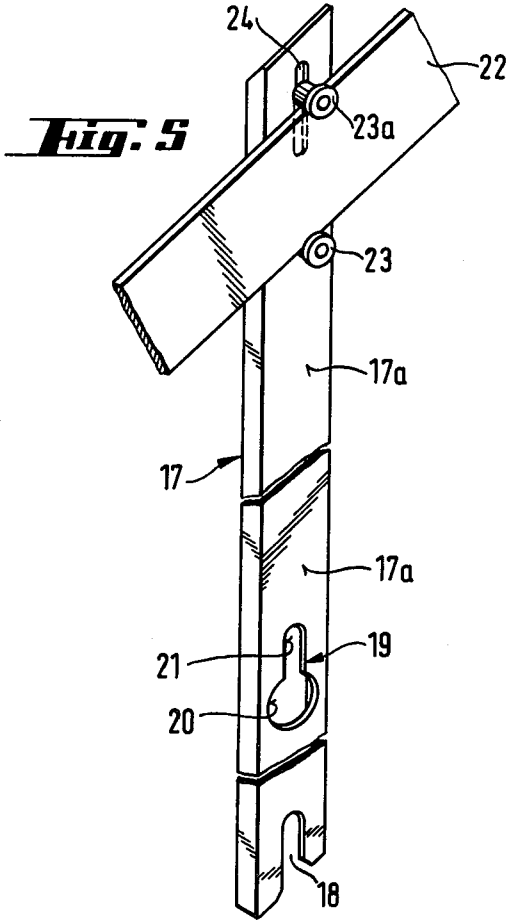
Figure 7:
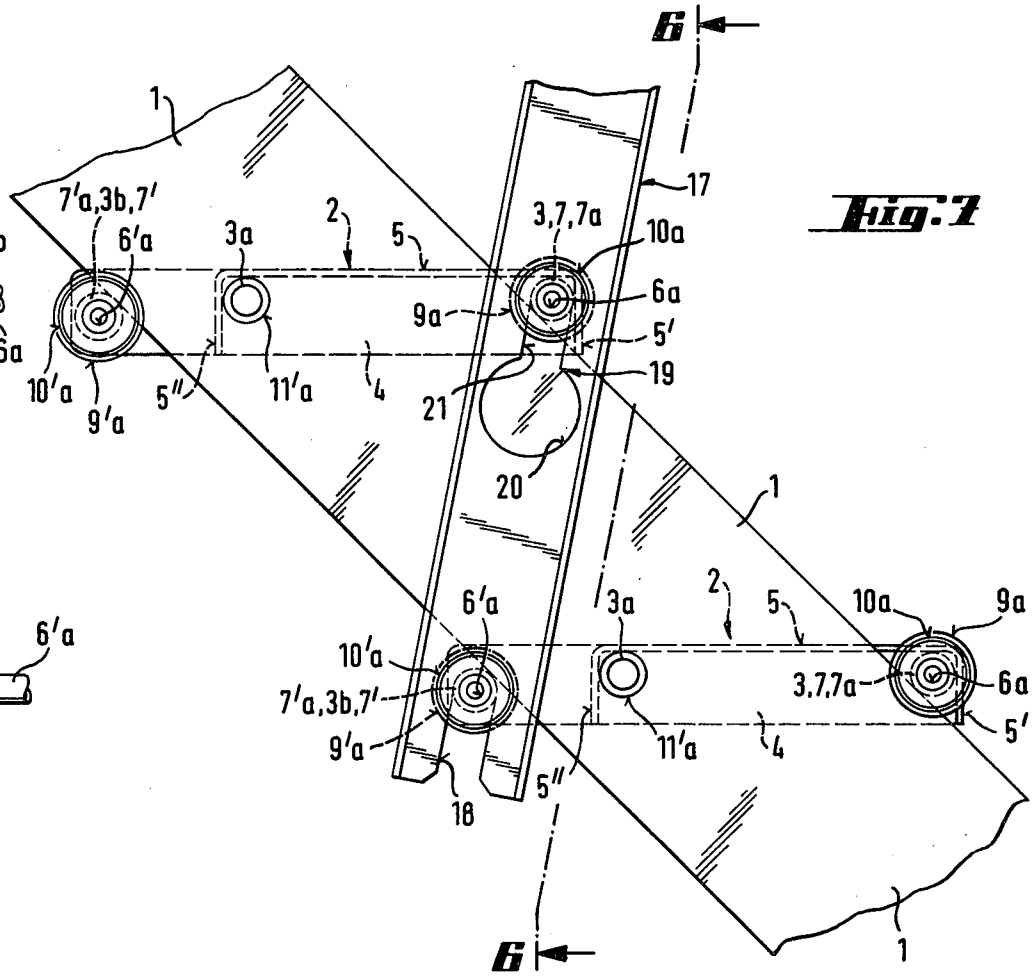
Figure 6:
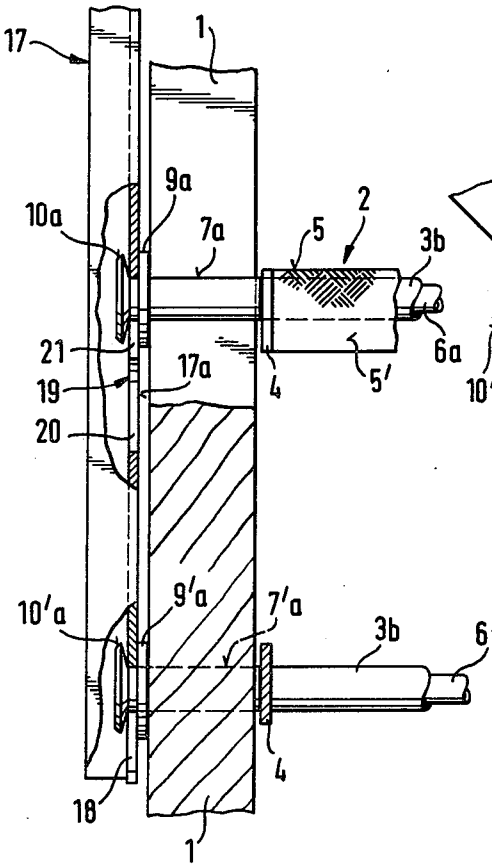
Figure 9:
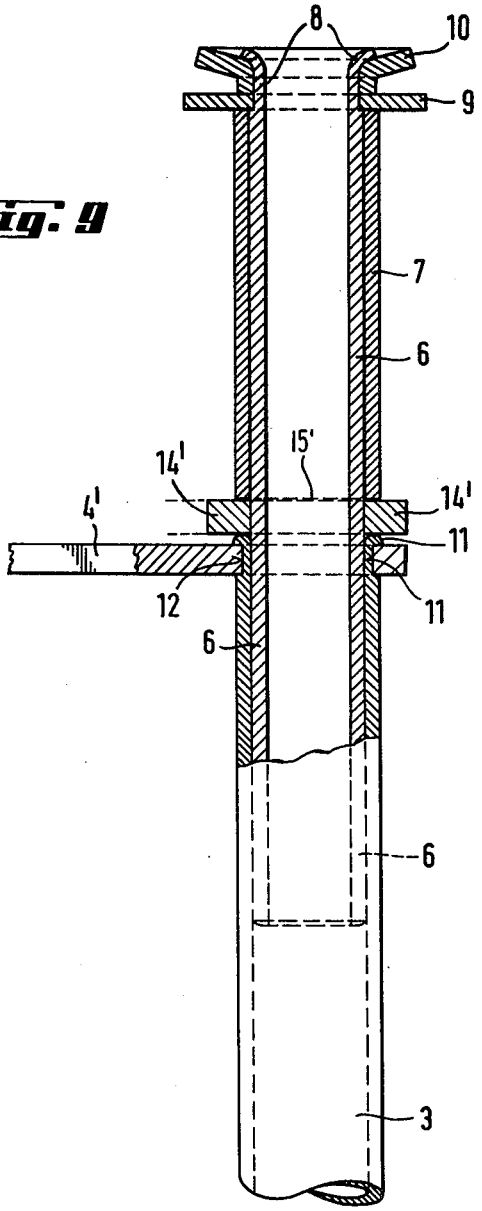
Figure 10:
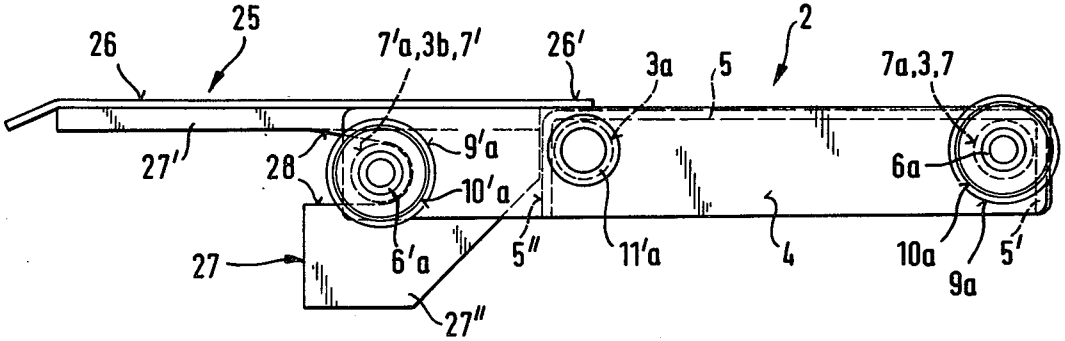

To assist in an understanding of the invention, it has now been described in relation to an attached drawing, which shows purely as examples:

FIG. 1, a general diagrammatic view of a temporary stair according to this invention according to one possible form of embodiment;

FIG. 2, a partial enlarged, exploded view of the components forming the steps according to FIG. 1;

FIG. 3, an enlarged view of the complete element to be assembled according to one form of embodiment of the steps;

FIG. 4, a view identical to FIG. 3 of another form of embodiment of the steps;

FIG. 5, a partial perspective view of the complementary element to be assembled, a hand rail stanchion;

FIG. 6, a partial cross-sectional view, partly cut away, of the stanchion shown in FIG. 5, slid onto an element forming a step;

FIG. 7, a partial side view of a temporary stair comprising a hand rail stanchion;

FIG. 8, an enlarged view of the hand rail stanchion at the level of a plank forming the hand rail;

FIG. 9, a partial enlarged view, in median horizontal section, of a portion of the components forming a step according to FIG. 1;

In FIG. 10, a lateral profile view in a support step hooked onto a succeeding step.

In FIG. 1 is shown a pair of planks (1, 1'), longitudinally sawn from wood, of identical general dimensions, which are especially commonly used in the construction industry, and which have a similar thickness and a similar width, although pairs of different lengths may be used; on these planks are placed steps (2) formed (FIG. 2) of tubes (3,3*a*, 3*b*) held between two cheek plates (4,4'); on two tubes (3,3*a*) a grooved or scored metal plate (5), having a non-slip surface, forms the step proper; this plate (5) comprises two perpendicular returns (5',5'') assuring its fixing on the tubes (3,3*a*).

It is with the objective of limiting the depth of the plates (steps) (5) that three tubes are provided, but it would be possible to provide only two tubes; however, since it is necessary to provide a certain distance (approximately 35 cm) between the two extreme tubes (3,3*b*) in order to achieve a horizontal orientation of the plates (5), that is to say of the steps, the solution involving three tubes (3,3*a*, 3*b*) is preferable; this moreover enables a further support step to be hooked on.

The two extreme tubes (3,3*b*) are each extended, at each of the two ends, by a support bushing (6,6', 6*a*,6'*a*). Onto these bushings (6,6', 6*a*,6'*a*), which are partially pushed into and held in the tubes (3,3*b*), there are slid, on the one hand bearing members, (7,7',7*a*,7'*a*) having a length just slightly exceeding the thickness of the planks (1,1'), and on the other hand, thereafter, onto the end (8,8',8*a*,8'*a*) of smaller external diameter of the bushings (6,6',6*a*,6'*a*), simple washers (9,9', 9*a*, 9'*a*) of corresponding aperture, and finally also another, special washer also of corresponding aperture, in the form of a bowl having a wide, slightly inclined edge (10,10',10a,10'a). Preferably, both the edges of the two reduced diameter ends (11,11a,11b,11',11'a,11'b) of the tubes (3,3a,3b) and those of the ends (8,8',8a,8'a) of the bushings (6,6',6a,6'a) are, on the one hand for the tubes after final positioning of the cheek plates (4,4'), and for the bushings after positioning of the bearing members (7,7',7a,7'a), the simple washers (9,9',9a,9'a) and the special washers (10,10',10a,10'a) on the other hand, brought outwards by the technique of riveting (see FIG. 9).

As can be seen in FIGS. 2 and 3, the pair of internal cheek plates (4,4') comprises three apertures (12,12a,12b) permitting passage of the ends (11,11a,11b) of reduced external diameter of the tubes (3,3a,3b), while if a pair of external cheek plates (13,13'; FIG. 4) is provided, the latter comprise only two apertures (not visible as such) for the passage of the rivets or other means which hold the bushings or only those tubes (3,3b) that are extended.

Each of the two front bushings (6,6a) hold a flat (14,14') slid, by an opening (15,15') situated at one end of these flats, onto said bushings (6,6a), these flats (14,14') terminating at the other end in the shape of a hook (16,16').

As can be seen in FIG. 1, these hooks (16,16') of one step (2) are designed to engage on the rear bushing (6,6'a) of the step below and the length of the flats (14,14') will of necessity be greater than the width of the planks (1,1').

As can be seen in FIG. 1, the steps (2) grip, on either side, a plank (1 or 1') between, respectively, the inner cheek plate (4 or 4') and the simple washers (9,9a) or (9', 9'a). The bearing members (7,7a) of the front bushings (6,6a) of the steps (2) bear on the planks, respectively (1,1'), and the bearing members (7',7'a) of the rear bushings (6',6'a) are pulled onto these planks (1,1').

In the case where elements to be assembled together forming steps are provided according to the form of embodiment of FIG. 4, that is to say comprising external cheek plates (13,13'), it is necessary to arrange for all the steps from the first to the last to be threaded onto the planks (1,1'), these planks being clamped between the two internal cheek plates (4,4') and external cheek plates (13,13'), thus rendering this form of embodiment less advantageous.

It is possible to use merely a temporary stair simply composed of a pair of stringers and of steps, or, on the other hand, equipped with one or two guard rails, that is to say on one or both sides of the temporary stair.

This guard rail of one lateral side generally identical with that of the other lateral side of the temporary stair may be constructed in the usual manner commonly employed today on building sites, that is to say from timber elements, posts nailed onto the planks (1,1') forming the vertical stanchions and boards then fixed to these stanchions forming the hand rail proper.

Preferably, however, complementary elements to be assembled are used, comprising hand rail stanchions (17) (FIGS. 5 to 8), elements formed of a straight, hollow structural section, for example rectangular section as shown, equipped on the side (17a) intended to bear against a plank (1) at its lower end with a longitudinal cut-out (18) extending upwards, enabling the lower part of the side (17a) of the stanchion (17) to ride on the special washer (10'a) of the rear bushing (6'a) of a step, while the washer (9'a) bears against the internal face of the side (17a) of the stanchion (17) and, at a predetermined height, an aperture (19) having the shape of a water droplet or keyhole, the spherical, widened out lower portion (20) of which has a diameter at least sufficiently large to permit the special washer (10a) of the upper step to pass into it, whereas the narrower, straight portion (21) of this aperture (19) has a width less than the large diameter of the special washer (10a) but greater than its small diameter, so that this special washer (10a), slid onto the front bushing (6a), being passed through the aperture (19) at the level of its wider portion (20), if the stanchion (17) is then moved down its side (17a) will ride upon the special washer (10a) and the side (17) will be held, both by the simple washer (9a) and special washer (10a) of a higher step and by the simple washer (9'a) and special washer (10'a) of a lower step.

At the upper part of the stanchion (17) there is provided a fixing means for a board (22) forming the guard rail or hand rail; this means may be a simple hole passing right through the stanchion (17) and permitting, for example, the passage of a cord intended for fixing the boards constituting the guard rail; but in a preferred manner, as shown in FIGS. 5 and 8, means are provided for gripping and holding the board (22) to the upper part of the inner face (17a) of the stanchion (17); these means consist of two half-bobbins (23,23a), cylinders having widened-out heads, the lower one (23) being fixed and the other, higher half-bobbin (23a) being movable in a vertical slit (24) of the stanchion and the upper half-bobbin (23a) being capable of being blocked (for example by a butterfly nut, not shown) in this slit (24) after having been pushed (arrow 24') onto the edge face of the board (22).

Preferably, in order to hold the topmost, first step (2) perfectly, that is to say to lock its rear bushing or the bearing member slid onto it, provision is made (FIG. 10) for hooking onto it a bearing step (25), these two steps (2 and 25) thus constituting a top step or landing step; the bearing step (25) being composed simply of a non-slip plate (26) of the same width as the plates (5) forming the steps (2); this plate (26) being fixed to two cheek plates (27) of hook form, that is to say that they comprise a horizontal slot or throat (28) enabling the bearing step (25) to be hooked by this throat (28) onto the free rear tube (3b) of the top step (2). To provide adequate rigidity to the bearing step (25) these hook-shaped cheek plates (27) are constituted of angle members, the horizontal side (27') of which is substantially longer than the vertical side (27'') comprising the throat (28); nevertheless, the plate (26) comprises at the front, over a certain depth and across its entire width, a free tongue (26') which can rest on the plate (5) of the top step (2). Furthermore, since the vertical sides (27'') of the cheek plates do not extend backwards either over the entire depth, the step (25) may also rest on the floor level (not illustrated) which the stair connects with, in such a way that the landing step, that is to say the top step (2) and the bearing step (25) which is affixed thereto, bear on the floor level of this storey and for this reason are held up.

Although a bearing step (25) is provided more especially at the top step, in order to hold the latter and to form a landing step, it is also possible to arrange for a bearing step (25) identical to that shown, or of lesser depth, to be hooked onto each of the other steps of the stair.

I claim:

1. A temporary stair, comprising a pair of planks of substantially identical cross-section, a plurality of steps substantially identical with one another, each step comprising at least two tubes extending between and connected to said planks, a plate engaging said tubes and forming a non-slip surface of the step proper, a plurality of check plates, the tubes being formed with reduced diameter ends, the check plates being formed with openings, and the reduced diameter ends being slid into said openings, two of said tubes being separated by a distance exceeding the width of the planks, a plurality of bushings each having a length exceeding the thickness of a plank, the bushings being held on the tubes, a plurality of bearing members respectively mounted on said bushings, each bearing member having a length slightly greater than the thickness of the planks, a plurality of flats respectively pivotally mounted at one end on one of said bushings and formed at the other end with a hook-shaped portion engageable with the bushing of the step placed next below, in such a manner that each step rests, at each side at the front, on a bearing member, another bearing member being pulled against the lower edge of each plank by a flat connected to the step placed next above.

2. A temporary stair according to claim 1, characterized in that each of the steps comprises three tubes, of which a first two hold the plate, the plate comprising two returns extending perpendicularly downwards, and one of the first two tubes and the third tube being extended at each end by bushings slid thereinto and held therein.

3. A temporary stair according to claim 1 or 2, characterized in that the edges of the reduced diameter end of the tubes of the reduced diameter ends are brought outwards after the cheek plates have been positioned and the edges of the reduced diameter ends of the bushings are brought outwards after positioning of the flats.

4. A temporary stair according to claim 3, further comprising a simple washer and a special washer mounted on each reduced diameter end of each bushing, the special washing having a first portion of lager diameter and a second portion of smaller diameter, a plurality of guard rail stanchions, each of these stanchions being composed of a straight, hollow structural member equipped on one side, intended for bearing against a plank, at its lower end with a longitudinal cut-out extending upwards and permitting the side of the stanchion to ride on the special washers and being formed at a determined height above the lower end with an aperture having a widened-out, spherical lower portion which is of a diameter sufficiently large to permit the entry of the special washers and being formed with a narrower portion which has a width less than the larger diameter of the special washers but greater than the smaller diameter of said special washers, so that, after the stanchion has been moved downwards, its side will also ride on the special washers of the upper step.

5. A temporary stair according to claim 4, characterized in that each of the stanchions comprises, at its upper part, two half-bobbins of cylindrical form with a widened-out head, one being fixed and the other being movable in a vertical slit provided in the side of the stanchion, the movable half-bobbin being capable of being blocked in this slit.

6. A temporary stair according to claim 1 or 2, characterized in that a bearing step is hooked onto the top step, these steps forming together a landing step, two hook-shaped cheek plates, the bearing step comprising a non-slip plate fixed to the two hook-shaped cheek plates, the hook-shaped cheek plates comprising a horizontal slot enabling hooking the bearing step to a tube of the top step, and the hook-shaped cheek plate not extending across the entire width of the plate of the step, thus leaving free a tongue which can rest upon the plate of the top step.

7. A temporary stair according to claim 6, characterized in that a bearing step is hooked onto a step other than the top step.

* * * * *